US009895873B2

(12) United States Patent
Chiari et al.

(10) Patent No.: US 9,895,873 B2
(45) Date of Patent: Feb. 20, 2018

(54) ADJUSTMENT METHOD AND ARRANGEMENT FOR A PRINTING MACHINE

(71) Applicant: BOBST MEX SA, Mex (CH)

(72) Inventors: Mauro Chiari, Denges (CH); Nicolas Mosetti, Froideville (CH); Daniel Tapis, Crissier (CH); Daniel Tatti, Vufflens-la-Ville (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 14/353,737

(22) PCT Filed: Oct. 8, 2012

(86) PCT No.: PCT/EP2012/004204
§ 371 (c)(1),
(2) Date: Apr. 23, 2014

(87) PCT Pub. No.: WO2013/060416
PCT Pub. Date: May 2, 2013

(65) Prior Publication Data

US 2014/0251170 A1 Sep. 11, 2014

(30) Foreign Application Priority Data

Oct. 24, 2011 (EP) ..... 11008517

(51) Int. Cl.
*B41F 21/00* (2006.01)
*B41F 3/56* (2006.01)
(Continued)

(52) U.S. Cl.
CPC ..... *B41F 3/56* (2013.01); *B41F 5/24* (2013.01); *B41F 21/00* (2013.01);
(Continued)

(58) Field of Classification Search
CPC ..... B41F 21/00
See application file for complete search history.

(56) References Cited

U.S. PATENT DOCUMENTS 4,471,693 A * 9/1984 Tsukasaki ..... 101/183
4,527,788 A * 7/1985 Masuda ..... 101/248
(Continued)

FOREIGN PATENT DOCUMENTS

DE 195 10 677 A1 10/1996
EP 0 616 886 A1 9/1994

OTHER PUBLICATIONS

International Search Report dated Jun. 3, 2013 issued in corresponding International patent application No. PCT/EP2012/004204.

*Primary Examiner* — Jill Culler
(74) *Attorney, Agent, or Firm* — Ostrolenk Faber LLP

(57) ABSTRACT

A method of adjusting a machine (1) for printing plate elements (12) equipped with at least one rotary impression cylinder (27) includes the steps of measuring a speed of the element (12, 13) passing through the machine (1), generating an operating signal (34) as a function of the measured speed and a tangential speed of the cylinder (27), and adjusting an operating speed of the machine (1) as a function of the signal generated so that the operating speed of the machine (1) is such that the speed of the element (12, 13) is substantially equal to the tangential speed of the cylinder (27).

14 Claims, 1 Drawing Sheet

(51) Int. Cl.

| | |
|---|---|
| ***B41F 33/00*** | (2006.01) |
| ***B41F 5/24*** | (2006.01) |
| *B41F 21/10* | (2006.01) |
| *B41M 1/04* | (2006.01) |
| *B41M 1/06* | (2006.01) |
| *B41M 1/10* | (2006.01) |

(52) U.S. Cl.
CPC ..... *B41F 33/0009* (2013.01); *B41F 21/102* (2013.01); *B41M 1/04* (2013.01); *B41M 1/06* (2013.01); *B41M 1/10* (2013.01); *B41P 2200/12* (2013.01)

(56) References Cited

U.S. PATENT DOCUMENTS

| | | | | | |
|---|---|---|---|---|---|
| 4,847,775 | A * | 7/1989 | Roch et al. | 700/125 | |
| 5,103,733 | A * | 4/1992 | Drapatsky et al. | 101/485 | |
| 5,213,036 | A * | 5/1993 | Tokuno et al. | 101/232 | |
| 5,383,392 | A * | 1/1995 | Kowalewski et al. | 101/183 | |
| 5,696,690 | A * | 12/1997 | Richardson | B41J 13/0027 | 271/3.01 |
| 5,927,194 | A * | 7/1999 | Jeschke | 101/183 | |
| 6,095,043 | A * | 8/2000 | Hartmann et al. | 101/183 | |
| 7,127,992 | B2 * | 10/2006 | Damm et al. | 101/474 | |
| 7,827,914 | B2 * | 11/2010 | Fernandez | B41J 11/46 | 101/228 |
| 2002/0124750 | A1 | 9/2002 | Norman et al. | | |
| 2009/0066017 | A1 * | 3/2009 | Matsuse | B65H 7/18 | 271/259 |

* cited by examiner

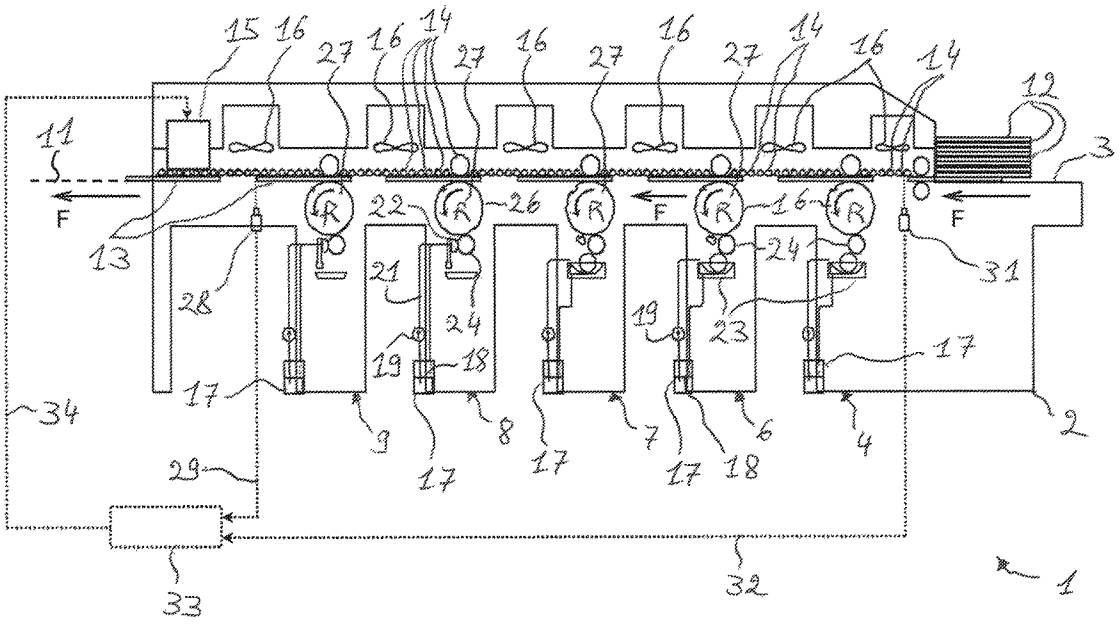
1
2
3
4
6
7
8
9
11
12
13
14
15
16
17
18
19
21
22
23
24
26
27
28
29
31
32
33
34
F

ADJUSTMENT METHOD AND ARRANGEMENT FOR A PRINTING MACHINE

CROSS REFERENCE TO RELATED APPLICATIONS

The present application is a 35 U.S.C. §371 National Phase conversion of PCT/EP2012/004204, filed Oct. 8, 2012, which claims benefit of European Application No. 11008517.2, filed Oct. 24, 2011, the disclosure of which is incorporated herein by reference. The PCT International Application was published in the French language.

TECHNICAL FIELD OF THE INVENTION

The present invention concerns a method for automatically adjusting a machine for printing plate elements. The invention relates to an adjustment arrangement intended for a machine for printing plate elements. The invention also concerns a printing machine having an adjustment arrangement.

BACKGROUND OF THE INVENTION

A printing machine is used in the packaging industry to print plate elements, such as sheets of paper or cardboard. The machine includes a plurality of successive stations. A first station located most upstream is an infeed station successively introducing the sheets one after the other from the bottom of a stack. The infeed station feeds a plurality of printing stations in the form of one or more printing units placed one after the other. Each of the printing units prints one color. A delivery station that collects the printed sheets is provided at the end of the machine.

In the case of printing sheets of cardboard, more particularly corrugated cardboard, the technology most frequently employed is flexographic printing. A flexo machine includes one or more printing units as a function of the number of colors required. A printing unit notably includes a plate cylinder around which is wrapped and on which is tensioned a flexible plate. This plate prints the sheet after it has been coated with ink using a screened cylinder known as the anilox cylinder and an inking device. The sheet passes between the plate cylinder and an pressure roller. The printing is effected on the bottom of these sheets, so the sheets are transported from the top. A plate cylinder prints one or more patterns using the same color during each of its rotations.

The plates are produced with a screen that consists of a rectangular array of larger or smaller dots. This screen is used to transform a half-tone original, for example a photo, into a printable dotted image. Screens with round dots are most frequently used in flexographic printing. The dots enable better reproduction of details and a better transition between tones.

To obtain a final image of good quality on the printed sheet, it is notably necessary for all the patterns in different colors to be superposed exactly. It is also necessary that the screen dots are not deformed, for example from a round shape to an oval shape.

The sheets are transported by a vacuum system using a belt or flat belts or steel rollers driven to move the sheets longitudinally from one printing unit to another in the upstream to downstream direction, from the infeed station to the delivery station. To obtain printing of optimum quality, the basic principle is that the sheets are transported at the most regular speed possible.

However, the belt(s) wear and stretch and the sheet transport speed is no longer regular from one job to another. The performance of the machine is degraded. Maintenance of the transport system takes time and involves stopping production completely. In the case of roller conveyors, it is the non-homogeneous nature of the sheets to be printed or being printed that causes speed variations. Ovalization or deformation of the printed screen dots can be seen on the printed sheets.

SUMMARY OF THE INVENTION

A main objective of the present invention consists in developing a method enabling adjustment of a machine for printing plate elements. A second objective is to improve and to maintain constant the printing quality of a printing machine. A third objective is to reduce the adjustment time or the down times and the number of plate elements printed to adjust a printing machine. A fourth objective is to employ a method for automatic, simple and rapid adjustment of a machine thanks to a specific arrangement. A fifth objective is to provide an adjustment method enabling the disadvantages of the prior art methods and arrangements to be avoided. A further objective is for the operator to succeed in adjusting a machine before starting production printing.

A method in accordance with one aspect of the present invention is for adjusting a machine for printing plate elements equipped with at least one rotary impression cylinder. The adjustment method includes the steps of:

- measuring a speed of the plate element passing through the machine for printing plate elements,
- generating an operating signal for the machine for printing plate elements as a function of the measured speed of the plate element and a tangential speed of the rotary impression cylinder or cylinders, and
- adjusting an operating speed of the machine for printing plate elements as a function of the operating signal generated,
- so that the operating speed of the machine for printing plate elements is such that the speed of the plate element is substantially equal to the tangential speed of the rotary impression cylinder or cylinders.

In other words, the real speed of the machine is regulated to avoid a speed difference between the speed of the plate element and the tangential speed of the plate carried by the impression cylinder, which causes printing of poor quality because the screen dots are deformed. With this adjustment, the speed of the transported plate element is perfectly synchronized with the tangential speed of the rotary impression cylinder and therefore with the tangential speed of the plate fixed to the rotary impression cylinder. With this adjustment, the tangential speed of the rotary impression cylinder and therefore the tangential speed of the plate fixed to the rotary impression cylinder is perfectly synchronized with the speed of the transported plate element.

Moreover, such a method enables easy starting of a job in the machine because all the colors are in the same row and at the same place on the plate element.

In accordance with another aspect of the invention, an adjustment arrangement for a machine for printing plate elements is intended to implement the method. In accordance with a further aspect of the invention, an arrangement for adjusting a machine for printing plate elements equipped with at least one rotary impression cylinder includes:

detector means adapted to detect the passage of a plate element and to send a detection signal, and a calculation and control unit connected to the detector means, receiving the signal from the detector means, and able to calculate the speed of the element passing through the machine for printing plate elements and to generate automatically an operating signal for the printing machine such that the operating speed of the machine for printing plate elements is such that the speed of the plate element is substantially equal to the tangential speed of the rotary impression cylinder or cylinders.

In accordance with a further aspect of the invention, a printing machine including at least one printing unit provided with a rotary impression cylinder is characterized in that it includes an adjustment arrangement having one or more of the technical features described hereinafter and claimed.

Throughout the description, the board or sheet element is defined by way of non-exhaustive example as being made from a material such as paper, flat cardboard, corrugated cardboard, laminated corrugated cardboard, flexible plastic, for example polyethylene (PE), polyethylene terephthalate (PET), bi-oriented polypropylene (BOPP) or other polymers, or other materials suitable for printing.

The longitudinal direction is defined with reference to the direction of movement of the plate element in the machine, along its longitudinal median axis. The upstream and downstream directions are defined with reference to the direction of movement of the element in the longitudinal direction of the printing machine as a whole. The front edge of the element is defined with reference to the direction of movement in the longitudinal direction in the printing machine as a whole.

BRIEF DESCRIPTION OF THE DRAWINGS

The invention will be clearly understood and its various advantages and features will emerge more clearly from the following description of the nonlimiting embodiment with reference to the appended diagrammatic drawing in which the single FIGURE represents a lateral general view of a printing machine including an adjustment arrangement in accordance with the invention.

DETAILED DESCRIPTION OF PREFERRED EMBODIMENTS

As the FIGURE shows, a printing machine 1, such as a flexo printing machine, includes:

a frame 2, a feeder or infeed station 3, one or more printing units, in this case five successive printing units 4, 6, 7, 8 and 9 in line printing five different colors, for example black, blue, red, green and yellow, and a machine outfeed or delivery station 11 (shown in dashed outline).

The infeed station 3 receives a stack of plate elements, for example in the form of unprinted sheets 12 of corrugated cardboard and sends them one after the other into the first printing unit 4. At the outfeed of the machine 1 the delivery station 11 then recovers the printed sheets 13.

The sheets 12 and 13 pass from one printing unit to another (arrow F), from the infeed station 3 to the delivery station 11 in the longitudinal direction. The sheets 12 and 13 are transported by drive means in the form of series of top drive rollers 14. The rollers 14 are driven by a motor 15, its motor drives and the necessary gears and transmission devices (see for example the document EP 0.363.662). The sheets 12 and 13 are pressed against the rollers 14 by a series of vacuum suction arrangements 16 disposed between the printing units 4, 6, 7, 8 and 9.

A printing unit may include an inking device 17 with a lower ink reservoir 18, a pump 19, means 21 for circulating the ink and a squeegee chamber 22 (last two printing units 8 and 9). A printing unit may also include an inking device 17 with a lower ink reservoir 18, a pump 19, means 21 for circulating the ink and an inking roller dipping into an ink pan 23 (first three printing units 4 to 7). The inking device 17 inks an anilox cylinder 24.

The anilox cylinder 24 coats with ink the plate 26 mounted on the exterior surface of a printing plate cylinder 27. The plate cylinder 27 is driven in rotation (arrow R) by rotating means such as a motor, its motor drives and the necessary gears and transmission devices, which enables adjustment of the angular position and/or the speed of the plate 26 relative to the sheet 12.

In accordance with a first embodiment of the method in accordance with the invention the operating speed of the machine 1 is adjusted using the drive means 14 and 15. The new speed at which the sheet 12 passes through is therefore synchronized with the tangential speed of the plate or plates 26 fixed to the respective plate cylinder or cylinders 27. This process is effected thanks to an arrangement for adjusting the speed of the drive means 14 and 15 in the machine 1.

In accordance with a second embodiment (not shown), the operating speed of the machine 1 is adjusted using means for rotating the plate cylinder or cylinders 27. The new tangential speed of the plate or plates 26 fixed to the respective plate cylinder or cylinders 27 and the tangential speed of the plate cylinder or cylinders 27 are therefore synchronized with the speed at which the sheet 12 passes through. This process is effected using an arrangement for adjusting the speed of the means for rotating the plate cylinder or cylinders 27 in the machine 1.

The adjustment arrangement includes detector means adapted to detect the passage of the sheets 12 and 13. In a first example, the detector means are formed by a sensor 28 for sending the front edge of the printed sheet 13. This sensor 28 is advantageously installed downstream of the last plate cylinder 27 corresponding to the output of the last printing unit 9. For accurate calculation of the speed, this sensor 28 is installed as far downstream as possible from the infeed station 3 and just upstream of the delivery station 11. The detector means, i.e. the sensor 28, send a detection signal 29 as soon as the printed sheet 13 passes it.

In accordance with a second example, the detector means are preferably formed by two sensors of the front edge of the non-printed sheet 12 and the printed sheet 13. The first of these two front edge sensors is similar to the sensor 28 of the first example.

The second of these front edge sensors is formed by a sensor 31 for sensing the front edge of the sheet 12. This second sensor 31 is installed upstream of the first plate cylinder 27, corresponding to the input of the first printing unit 4. For accurate calculation of the speed, this sensor 31 is installed as far upstream as possible from the delivery station 11 and just downstream of the infeed station 3. The detector means, i.e. the second sensor 31, send a detection signal 32 as soon as the non-printed sheet 12 passes it.

The adjustment arrangement further includes a calculation and control unit 33. In the first embodiment, the unit 33 is connected to the detector means, i.e. to a sensor 28 or to the two sensors 28 and 31, and also to the means 15 for driving the rollers 14. In the second embodiment the unit 33 is connected to the detector means, i.e. to a sensor 28 or to the two sensors 28 and 31, and also to the means for rotating the plate cylinder or cylinders 27. The unit 33 receives the signal from the detector means 28 or 28 and 31.

The unit 33 is able to calculate the speed of the non-printed sheet 12 and of the printed sheet 13 passing through the machine 1 and is able to generate an adjustment signal for operation of the machine 1. In the first embodiment, the unit 33 is consequently able to generate automatically an adjustment signal 34 for the drive means 15. The adjustment signal 34 makes it possible to equalize the speed of the sheet 12 or 13 with the tangential speed of the plate or plates 26 on its respective plate cylinder or cylinders 27. In the second embodiment the unit 33 is consequently able to generate automatically an adjustment signal for the means for rotating the plate cylinder or cylinders 27. The adjustment signal 34 makes it possible to equalize the tangential speed of the plate or plates 26 on its respective plate cylinder or cylinders 27 with the speed of the sheet 12 or 13.

In the first and second embodiments the adjustment signal 34 makes it possible to equalize the speed of the drive means 15 with the tangential speed of the plate cylinder or cylinders 27.

The method of adjusting the machine 1 includes a plurality of successive steps following on from the steps of printing the pattern or patterns on the sheets 12.

In a first step, the speed of the non-printed sheet 12 and the printed sheet 13 passing through the machine 1 (arrow F) is measured. This step consisting in measuring the speed of the sheet 12 or 13 passing through the machine 1 (arrow F) may be implemented by calculation determining the time for the sheet 12 or 13 to pass between a machine input, i.e. the infeed station 3, and a machine outfeed, i.e. the delivery station 11.

This step consisting of measuring the speed of the sheet 12 or 13 passing through the machine 1 (arrow F) may be implemented by calculation determining the time for the sheet 12 or 13 to pass upstream and downstream of the cylinder or cylinders 27.

This step consisting in measuring the speed of the sheet 12 or 13 passing through the machine 1 (arrow F) may also be implemented by sending and receiving waves, for example light waves or radar waves, reflected by the sheet 12 or 13.

In accordance with the first example, to determine the start of the passage time, a signal indicating departure of the sheet 12 is sent by the infeed station 3 of the machine 1 or by the machine 1 itself. This departure signal is similar to a departure pulse. To determine the end of the passage time, the passage of the sheet 12 is detected downstream of the plate cylinder or cylinders 27 of the respective printing unit or groups 4, 6, 7, 8 and 9, thanks to the sensor 28 which generates its detection signal 29. The real speed of the sheet 12 or 13 is calculated knowing the distance between the infeed station 3 and the sensor 28.

In accordance with the second example, to determine the start of the passage time the passage of the sheet 12 is detected upstream of the plate cylinder or cylinder 27 of the printer group or groups 4, 6, 7, 8 and 9 thanks to the second sensor 31 which generates its detection signal 32. To determine the end of the passage time the passage of the sheet 12 is detected downstream of the plate cylinder or cylinders 27 of the printing unit or groups 4, 6, 7, 8 and 9 thanks to the first sensor 28 which generates its detection signal 29. The real speed of the sheet 12 or 13 is calculated knowing the distance between the plate cylinder or cylinders 27 or between the two sensors 28 and 31.

In a second step of the method an adjustment signal 34 is generated by the unit 33 and sent to the drive means 15. This signal 34 is a function of the passage time F measured for the non-printed sheet 12 and the printed sheet 13, i.e. the calculated speed, and the rotation speed of the plate cylinder or cylinders 27. The real speed calculated for the non-printed sheet 12 and the printed sheet 13 is compared with the tangential speed of the plate cylinder or cylinders 27.

In a third step of the first embodiment of the method the speed of the drive means 15 is adjusted as a function of the adjustment signal 34 generated.

If the real speed calculated for the non-printed sheet 12 or for the printed sheet 13 is greater than the tangential speed of the plate or plates 26 on the respective plate cylinder or cylinders 27 the adjustment signal 34 generated takes a value corresponding to a deceleration of the drive means 15. If the real speed calculated for the non-printed sheet 12 and the printed sheet 13 is less than the tangential speed of the plate or plates 26 on the respective plate cylinder or cylinders 27 the adjustment signal 34 generated takes a value corresponding to an acceleration of the drive means 15. If the real speed calculated for the non-printed sheet 12 and the printed sheet 13 is equal to the rotation speed of the plate or plates 26 on the respective plate cylinder or cylinders 27 the adjustment signal 34 generated takes a null value.

The adjusted new speed for the drive means 15 is such that the new speed of passage of the sheet 12 or 13 is equal to the tangential speed of the plate or plates 26 on its plate cylinder or cylinders 27.

In a third step of the second embodiment of the method the speed of the means for rotating the plate cylinder or cylinders 27 is adjusted as a function of the adjustment signal generated.

If the real speed calculated for the non-printed sheet 12 and the printed sheet 13 is greater than the tangential speed of the plate cylinder or cylinders 27 the adjustment signal generated takes a value corresponding to an acceleration of the means for rotating the plate cylinder or cylinders 27. If the real speed calculated for the non-printed sheet 12 and the printed sheet 13 is less than the tangential speed of the plate cylinder or cylinders 27 the adjustment signal generated takes a value corresponding to a deceleration of the means for rotating the plate cylinder or cylinders 27. If the real speed calculated for the non-printed sheet 12 and the printed sheet 13 is equal to the rotation speed of the plate cylinder or cylinders 27 the adjustment signal generated takes a null value.

The adjusted new tangential speed for the means for rotating the plate cylinder or cylinders 27 is such that the new tangential speed of the plate or plates 26 on its plate cylinder or cylinders 27 is equal to the speed of passage calculated for the non-printed sheet 12.

The present invention is not limited to the embodiments described and shown. Numerous modifications may be made without departing from the scope of the invention defined by the set of claims. Sensors may be installed after each printing unit 4, 6, 7 and 8 and their information enables adjustment of the speed at which the printed sheets 13 are transported.

What is claimed is:

1. A method of adjusting a printing machine for printing plate elements, the printing machine being equipped with at least one rotary impression cylinder being driven at a constant tangential speed, a driving device for driving a plate element through the printing machine, and an infeed station positioned upstream of the impression cylinder, the method including the steps of:

measuring a speed of the plate element passing through the printing machine with a detector comprising a sensor disposed for detecting the front edge of the plate element, installed downstream of the impression cylinder, based on a signal from the sensor and a signal indicating departure of the plate element sent by the infeed station;

generating an operating signal as a function of the measured speed of the plate element, the operating signal being an adjustment signal for the driving device for driving the plate element; and adjusting an operating speed of the printing machine as a function of the operating signal generated, by adjusting only the speed of the driving device driving the plate element to a new speed of the driving device and keeping constant the new speed of the driving device driving the plate element, the tangential speed of the rotary impression cylinder remaining constant, so that the operating speed of the printing machine is adjusted such that the speed of the plate element driven with the new speed of the driving device is substantially equal to the constant tangential speed of the rotary impression cylinder.

2. The method as claimed in claim 1, wherein the step of measuring the speed is implemented by calculation determining the time of passage of the plate element between a machine input and a machine outfeed.

3. The method as claimed in claim 1, wherein the step of measuring the speed is implemented by calculation determining the time of passage of the plate element upstream and downstream of the cylinder.

4. The method as claimed in claim 2, wherein the time of passage is determined by detection of the passage of the element upstream and downstream of the cylinder.

5. The method as claimed in claim 2, wherein the time of passage is determined by a signal indicating departure of the element sent by an infeed station of the machine and by detection of the passage of the element downstream of the cylinder.

6. An adjustment arrangement for a printing machine for printing plate elements, the printing machine being equipped with at least one rotary impression cylinder being driven at a constant tangential speed, a driving device for driving a plate element through the printing machine, and an infeed station positioned upstream of the impression cylinder, the adjustment arrangement including:

a detector which detects the passage of a plate element and sends a detection signal, comprising a sensor disposed for detecting the front edge of the plate element, installed downstream of the impression cylinder, and a calculation and control unit connected to the detector and to the driving device for driving the plate element, wherein the calculation and control unit receives the detection signal from the detector, and a signal indicating departure of the plate element sent by the infeed station, the calculation and control unit measures the speed of the plate element passing through the printing machine, the calculation and control unit generates automatically an operating signal as a function of the measured speed of the plate element, the calculation and control unit generates automatically the adjustment signal for the driving device, and the calculation and control unit controls the operating speed of the printing machine by the generated operating signal, by adjusting only the speed of the driving device driving the plate element to a new speed of the driving device and keeping constant the new speed of the driving device driving the plate element, the tangential speed of the rotary impression cylinder remaining constant, such that the speed of the plate element driven with the new speed of the driving device is substantially equal to the constant tangential speed of the rotary impression cylinder.

7. The arrangement as claimed in claim 6, wherein the detector comprises either said sensor disposed for detecting the front edge of the plate element installed downstream of the impression cylinder, or two sensors disposed for detecting the front edge of the plate elements installed upstream and downstream of the impression cylinder.

8. A printing machine including at least one printing unit provided with an impression cylinder, including an adjustment arrangement as claimed in claim 6.

9. The machine as claimed in claim 8, wherein the driving means comprises a vacuum suction device and a series of drive rollers.

10. The machine as claimed in claim 8, wherein the driving means comprises a vacuum suction device and at least one drive belt.

11. The machine as claimed in claim 8, wherein the cylinder is a plate cylinder, the printing process being a flexographic printing process.

12. A method of adjusting a printing machine for printing plate elements, the printing machine being equipped with at least one rotary impression cylinder being driven at a constant tangential speed, the method including the steps of:

measuring a speed of a plate element passing through the printing machine with a detector comprising a pair of sensors disposed for detecting the front edge of the plate element, installed upstream and downstream of the impression cylinder, respectively, based on signals from both of said sensors;

generating an operating signal as a function of the measured speed and the constant tangential speed of the rotary impression cylinder; and adjusting an operating speed of the printing machine as a function of the operating signal generated by adjusting only the speed of the driving device driving the plate element to a new speed of the driving device and keeping constant the new speed of the driving device driving the plate element, the tangential speed of the rotary impression cylinder remaining constant, so that the operating speed of the printing machine is adjusted such that the speed of the plate element driven with the new speed of the driving device is substantially equal to the constant tangential speed of the rotary impression cylinder.

13. A method of adjusting a printing machine for printing plate elements, the printing machine being equipped with at least one rotary impression cylinder being driven at a constant tangential speed, and a driving device for driving a plate element through the printing machine, the method including the steps of:

A) measuring a speed of the plate element passing through the printing machine 1) with a first detector comprising a first sensor disposed for detecting the front edge of the plate element, installed downstream of the impression cylinder, and 2) with a second detector comprising a second sensor disposed for detecting the front edge of the plate element, installed upstream of the impression cylinder, based on a first signal from the first sensor and a second signal from the second sensor;

B) generating an operating signal as a function of the measured speed of the plate element, the operating signal being an adjustment signal for the device for driving the plate element; and C) adjusting an operating speed of the printing machine as a function of the operating signal generated, by adjusting only the speed of the driving device driving the plate element to a new speed of the driving device and keeping constant the new speed of the driving device driving the plate element, the tangential speed of the rotary impression cylinder remaining constant, so that the operating speed of the printing machine is adjusted such that the speed of the plate element driven with the new speed of the driving device is substantially equal to the constant tangential speed of the rotary impression cylinder.

14. An adjustment arrangement for a printing machine for printing plate elements, the printing machine being equipped with at least one rotary impression cylinder being driven at a constant tangential speed, and a device for driving the plate element through the printing machine, the adjustment arrangement including:

a first detector comprising a first sensor disposed for detecting the front edge of the plate element installed downstream of the impression cylinder which detects the passage of a plate element and sends a first detection signal, a second detector comprising a second sensor disposed for detecting the front edge of the plate element installed upstream of the impression cylinder which detects the passage of a plate element and sends a second detection signal, a calculation and control unit connected to the first and second detectors and to the driving device for driving the plate element, wherein the calculation and control unit receives the first and second detection signals from the first and second detectors, the calculation and control unit measures the speed of the plate element passing through the printing machine, the calculation and control unit generates automatically an operating signal as a function of the measured speed of the plate element, the calculation and control unit generates automatically the adjustment signal for the driving device, and the calculation and control unit controls the operating speed of the printing machine by the generated operating signal, by adjusting only the speed of the driving device driving the plate element to a new speed of the driving device and keeping constant the new speed of the driving device driving the plate element, the tangential speed of the rotary impression cylinder remaining constant, such that the speed of the plate element driven with the new speed of the driving device is substantially equal to the constant tangential speed of the rotary impression cylinder.

* * * * *